US008100675B2

(12) United States Patent
Miyazaki et al.

(10) Patent No.: US 8,100,675 B2
(45) Date of Patent: Jan. 24, 2012

(54) FLUID TRANSPORTING DEVICE, AND FLUID TRANSPORTER

(75) Inventors: Hajime Miyazaki, Katsumoto (JP); Kazuo Kawasumi, Chiro (JP); Kenichi Ushikoshi, Shiojio (JP)

(73) Assignee: Seiko Epson Corporation (JP)

( * ) Notice: Subject to any disclaimer, the term of this patent is extended or adjusted under 35 U.S.C. 154(b) by 1152 days.

(21) Appl. No.: 11/883,668

(22) PCT Filed: Feb. 1, 2006

(86) PCT No.: PCT/JP2006/302112

§ 371 (c)(1),
(2), (4) Date: Sep. 28, 2007

(87) PCT Pub. No.: WO2006/082998

PCT Pub. Date: Aug. 10, 2006

(65) Prior Publication Data

US 2008/0138222 A1 Jun. 12, 2008

(30) Foreign Application Priority Data

Feb. 4, 2005 (JP) ..... 2005-028583

(51) Int. Cl.
*F04B 43/12* (2006.01)

(52) U.S. Cl. ..... 417/477.6; 417/477.3; 417/479

(58) Field of Classification Search ..... 417/474, 417/476, 477.1, 477.2, 477.3, 477.8, 477.6, 417/479

See application file for complete search history.

(56) References Cited

U.S. PATENT DOCUMENTS

| | | | | |
|---|---|---|---|---|
| 5,575,631 | A | 11/1996 | Jester | |
| 5,683,233 | A | 11/1997 | Moubayed et al. | |
| 5,741,125 | A | 4/1998 | Neftel et al. | |
| 5,791,881 | A | 8/1998 | Moubayed et al. | |
| 5,924,852 | A | 7/1999 | Moubayed et al. | |
| 5,945,346 | A | 8/1999 | Vanell et al. | |
| 6,030,190 | A * | 2/2000 | Kammerer | 417/477.1 |

(Continued)

FOREIGN PATENT DOCUMENTS

| | | | |
|---|---|---|---|
| JP | 59-61943 | U | 4/1984 |
| JP | 7-217541 | A | 8/1995 |
| JP | 10-507799 | A | 7/1998 |
| JP | 11-137679 | A | 5/1999 |

(Continued)

OTHER PUBLICATIONS

International Search Report for PCT/JP2006/302112 dated Apr. 7, 2006.

*Primary Examiner* — Charles Freay
*Assistant Examiner* — Todd D Jacobs
(74) *Attorney, Agent, or Firm* — Harness, Dickey & Pierce, P.L.C.

(57) ABSTRACT

A fluid transporting device comprises a tube frame having a tube guide wall for arranging a tube having an elasticity in an arcuate shape, and a rotary pressure mechanism having a plurality of rollers. The rotary pressure mechanism is arranged, when the tube is arranged in the tube frame, on the side opposite to the guide wall side of the tube, such that its center of rotation is aligned with the center of the arc of the tube guide wall. A plurality of push pins are interposed between the tube and the rotary pressure mechanism and are arranged radially of the center of rotation of the rotary pressure mechanism. A switching mechanism moves at least one of the rollers to a position for the push pins to release the tube and a position for the push pins to press the tube.

10 Claims, 7 Drawing Sheets

U.S. PATENT DOCUMENTS

| | | | | |
|---|---|---|---|---|
| 6,106,249 | A | 8/2000 | Barak | |
| 6,149,508 | A | 11/2000 | Vanell et al. | |
| 6,164,921 | A * | 12/2000 | Moubayed et al. | 417/44.1 |
| 6,203,295 | B1 * | 3/2001 | Nishioka | 417/476 |
| 6,733,255 | B2 * | 5/2004 | Ota et al. | 417/477.7 |
| 6,733,476 | B2 * | 5/2004 | Christenson et al. | 604/151 |

FOREIGN PATENT DOCUMENTS

| | | | |
|---|---|---|---|
| JP | 11-224868 | A | 8/1999 |
| JP | 2000-62208 | A | 2/2000 |
| JP | 3109015 | B1 | 9/2000 |
| JP | 2001-515557 | A | 9/2001 |
| JP | 2001-523995 | A | 11/2001 |

* cited by examiner

FLUID TRANSPORTING DEVICE, AND FLUID TRANSPORTER

TECHNICAL FIELD

The present invention relates to a fluid transporting device and a fluid transporter provided with the fluid transporting device.

BACKGROUND ART

In the prior art, as a first conventional technique, there is known a tube pump (Japanese Patent No. 3,109,015) as a fluid transporting device comprising: a holder having an inner circumference formed into a generally arcuate shape; a tube having an elasticity and held in the inner circumference; a rotary disc having a groove so shaped as to hold at least one roller for elastically deforming and closing one portion of the held area of the tube and that the roller can move, when rotated in one direction, to a position to close the tube and, when rotated in the other direction, to a position to keep an elastic state without closing the tube; and a rubber plate so disposed at a position for the roller to start the push of the tube as intersects with the revolution path of the roller.

As a second conventional technique, on the other hand, there is known an ink feed mechanism (JP-UM-A-59-61943) for an ink jet recording apparatus, comprising: at least one roller; placing means for placing a predetermined portion of a tube having an elasticity; and rotational radius varying means for rotating the roller around a center axis and for varying the radius of rotation of the roller in accordance with the rotating direction so that the roller may rotate around the center axis and so that the tube placed on the placing means may be pressed, when the roller rotates in a predetermined direction, but not when the roller rotates in the backward direction.

In the invention of the first prior art or the second prior art, however, the roller presses the tube directly thereby to feed the liquid. It is, therefore, thought that the liquid feeding portion (or the internal diameter of the tube) is varied as a result that the tube is stretched in the flow direction, thereby to make it difficult to keep the flow rate stably.

Moreover, the revolving direction of the roller to close the tube and the revolving direction to release the closure are determined to raise a problem that the direction to transport the fluid cannot be easily changed.

When the drive is interrupted while the roller being positioned to close the tube, moreover, it is thought that the roller is pushed back far away from the tube by the elastic force owned by the tube. In this case, there arises another problem that the closure of the tube is released to permit the leakage of the liquid.

The present invention has been conceived to solve the aforementioned problems, and contemplates to provide both a small fluid transporting device, which can rotate the rotary pressure mechanism forward and backward, which allows no leakage of the fluid even in the drive intermitting state and which can retain a stable fluid feeding rate, and a fluid transporter which is provided with that fluid transporting device.

DISCLOSURE OF THE INVENTION

According to the invention, there is provided a fluid transporting device characterized by comprising: a tube frame having a tube guide wall for arranging a tube having an elasticity in an arcuate shape; a rotary pressure mechanism arranged, when the tube is arranged in the tube frame, on the side opposite to the guide wall side of the tube, such that its center of rotation is aligned with the center of the arc of the tube guide wall, and having a plurality of rollers; a plurality of push pins interposed between the tube and the rotary pressure mechanism and arranged radially of the center of rotation of the rotary pressure mechanism; and a switching mechanism disposed in the rotary pressure mechanism for allowing at least one of the rollers to move, in association with the rotating motions of the rotary pressure mechanism, to a position where the push pins release the tube and a position where the push pins are capable of pressing the tube.

According to this invention, by the switching mechanism associated with the rotation of the rotary pressure mechanism, at least one of the rollers can be moved to a position for the push pins to release the tube and a position for the push pins to press the tube.

Moreover, the tube is pressed substantially at a right direction by the push pins so that the stretch of the tube can be made less than the prior art, in which the roller squeezes the tube directly. Moreover, at least one of the rollers can be moved to the position for the push pins to release the tube. By releasing the tube if the fluid transporting device is not driven, therefore, it is possible to prevent the plastic deformation of the tube, which might otherwise be predicted in case the tube is closed and left at the same position for a long time. As a result, it is possible to keep the stable fluid transportation rate.

Moreover, the switching mechanism is associated with the rotation of the rotary pressure mechanism so that the transportation of the fluid can be started without needing another driving force for the switching mechanism or the operation of the user.

Although the detail description is made in modes of embodiments to be described, moreover, the rotary pressure mechanism is arranged on the inner side of the tube, and the switching mechanism is disposed in the rotary pressure mechanism, so that the fluid transporting device of a small size can be realized.

In the invention, moreover, the fluid transporting device is characterized in that the switching mechanism includes: a rocking lever for moving at least one of the rollers to the position where the push pins release the tube and the position where the push pins are capable of pressing the tube; and a regulating lever for engaging with the rocking lever to regulate the position of the rocking lever and to hold the same position.

Thus, the rocking lever moves to the position for the push pins to release the tube and the position to press the tube, so that the regulating lever regulates the position of the rocking lever. This state can be realized by the simple structure having a smaller number of components. Moreover, the switching mechanism is disposed in the rotary pressure mechanism, so that the fluid transporting device of a thin type can be provided.

In the invention, moreover, the fluid transporting device is characterized: by further comprising a protruding portion fixedly protruding toward the rotary pressure mechanism in the vicinity of the outer circumference portion of the rotary pressure mechanism; and in that an end portion of the rocking lever abuts, as the rotary pressure mechanism rotates, against the protruding portion so that the rocking lever is rocked to move at least one of the rollers from the position for the push pins to release the tube to the position for the push pins to press the tube.

Thus, the rocking lever is rocked in association with the rotations of the rotary pressure mechanism and in abutment against the protruding portion, thereby to move the roller from the position for the push pins to release the tube and to the position to press the tube. Therefore, the fluid transportation can be started without any manual operation. Moreover, this state is held by the roller lever and the regulating lever so that the stable fluid transportation can be performed.

Moreover, the structure of the invention is characterized: in that the regulating lever is provided at its tail portion with a spring portion for applying a biasing force to rock the regulating lever in one direction; and in that the spring portion biases the rocking lever in a direction to engage with the regulating lever.

Here, the spring portion can adopt the structure, in which it is integrated with the regulating lever, or in which a spring member is disposed by itself.

Thus, the spring member biases the regulating lever and the rocking lever into engagement with each other. Therefore, the sizing error between the regulating lever and the rocking lever at the engaging time is absorbed by the spring member thereby to prevent a clearance from being formed in the engaging portions and a damage at the engaging time. Thus, it is possible to regulate the two positions of the aforementioned rocking lever precisely. As a result, the position of the roller to be moved can be precisely regulated.

Moreover, the invention is characterized in that the regulating lever includes an operation member for releasing the engagement with the rocking lever and for moving at least one of the rollers from the position for the push pins to press the tube to the position for the push pins to release the tube.

Thus, the operation member can be operated to establish a state, in which the tube is opened. When the drive of the fluid transporting device is interrupted for a long time, therefore, the push of the tube is released to prevent the tube from being plastically deformed, as might otherwise be caused when the tube is pressed for a long time. Moreover, this state can be manually established to give advantages that the disassembly and assembly are improved, and that the maintenance is facilitated.

On the other hand, a fluid transporter of the invention is characterized: by comprising a fluid transporting device as described above, and a fluid storing container for storing a fluid; and in that the fluid transporting device and the fluid storing container are made to communicate with each other by a tube having an elasticity so that the fluid in the fluid storing container is transported by the fluid transporting device.

According to this invention, the fluid transporting device of the aforementioned structure is adopted to provide the aforementioned advantage. At the same time, the fluid transporting device and the fluid storing container are made to communicate by the tube, so that the fluid storing container can be easily replaced to give an easy handling. The fluid transporting device can be repeatedly used to raise the economical advantage.

Because of the aforementioned state, in which the tube is closed, and because the rotary pressure mechanism can be rotated forward and backward, the fluid transporting direction can be arbitrarily changed. The fluid transporting device and the fluid storing container are made to communicate by the tube so that their arrangement can be easily changed. This makes it possible to pour the fluid into the fluid storing container from another tank or the like.

Moreover, the aforementioned invention is the fluid transporting device and the fluid storing container are formed in parallel in the planar direction in a casing.

According to this structure, the fluid transporting device and the fluid storing container are arranged to have no overlap, so that the size can be reduced without increasing the thickness. Moreover, the casings for the fluid transporting device and the fluid storing container are formed into one, so that the cost can be reduced.

INDUSTRIAL APPLICABILITY

The fluid transporting device and the fluid transporter of the invention can be mounted inside or outside of a variety of machine apparatus so as to transport a fluid such as water, brine, chemicals, oils, aromatic liquids, ink or gases. Moreover, the fluid transporter can be utilized by itself for feeding and supplying the aforementioned fluid, but should not be limited thereto.

Here, the fluid transporter according to this invention has its outer casing made of the material excellent in the organic matching property and is small so that it can suit a medical device to be mounted in a living body.

BEST MODE FOR CARRYING OUT THE INVENTION

A fluid transporting device according to the invention and a fluid transporter having the fluid transporting device are described in the following. Here, a mode of embodiment to be described in the following presents only one mode of embodiment, to which the invention should not be limited.

At first, the description is made on Mode of Embodiment 1 of the invention.

FIG. 1 to FIG. 8 show the fluid transporting device and the fluid transporter according to Mode of Embodiment 1.

Figure 1:
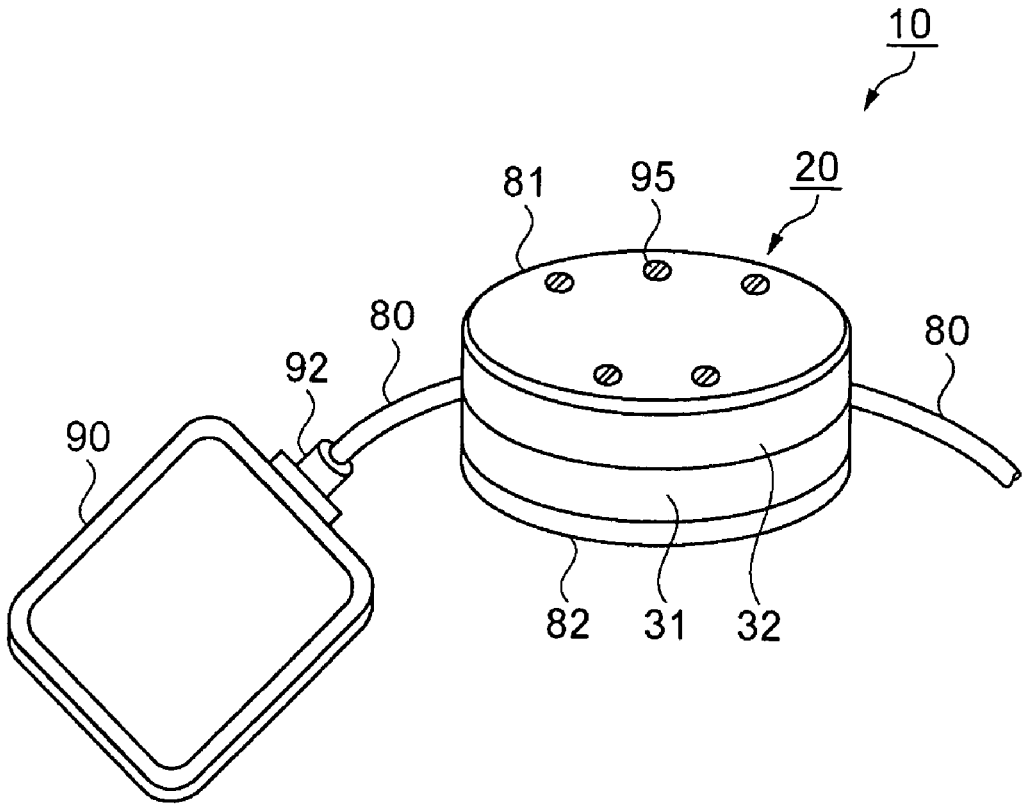
FIG. 1 A perspective view showing a constitution of a fluid transporter according to Mode of Embodiment 1 of the invention.

FIG. 1 is a perspective view showing a constitution of the fluid transporter of Mode of Embodiment 1. In FIG. 1, a fluid transporter 10 is constituted of a fluid transporting device 20 for transporting a fluid by writhing motions, and a pack-shaped fluid storing container 90 for storing the fluid. Moreover, the fluid transporting device 20 and the fluid storing container 90 are made to communicate with each other by a tube 80.

The fluid storing container 90 is made of a flexible synthetic resin and formed, in this mode of embodiment, of a silicone-family resin. The fluid storing container 90 is provided at its one end portion with a tube holding portion 92, in which the tube 80 is so hermetically fixed by removable connecting means such as a press fit or adhering means such as solvent weld or adhesion that the fluid may not leak.

Here, the fluid to be employed in the invention includes not only a fluidic liquid such as water, brine, chemicals, oils, aromatic liquids or ink but also gases.

The tube 80 communicates at its one end portion with the inside of the fluid storing container 90, and extends through the fluid transporting device 20 and to the outside of the fluid transporting device 20 so that the fluid stored in the fluid storing container 90 may be transported to the outside by the fluid transporting device 20.

The fluid transporting device 20 is constituted by laying a lower cover 82, a drive unit frame 31, a tube frame 32 and an upper cover 81 sequentially in the recited order and by integrating them by means of fixing screws 95 (although the upper cover fixing screws are shown). In this fluid transporting device 20, there is housed a rotary pressure mechanism for transporting the fluid.

In case the fluid transporter 10 is mounted inside or outside a living body, a material excellent in an organic matching property, such as a synthetic resin of polysulfone or urethane is preferably adopted for the lower cover 82, the drive unit frame 31, the tube frame 32, the upper cover 81 and the fluid storing container 90.

Here, the fluid transporting device 20 is given a structure capable of switching the fluid transporting direction, although described in detail hereinafter. The fluid storing container 90 and the fluid transporting device 20 are so structured that the tube 80 can be removed at the tube holding portion 92 thereby to exchange the right and left arrangements, as shown.

Subsequently, a mechanism for transporting a fluid is described with reference to the drawings.

Figure 2:
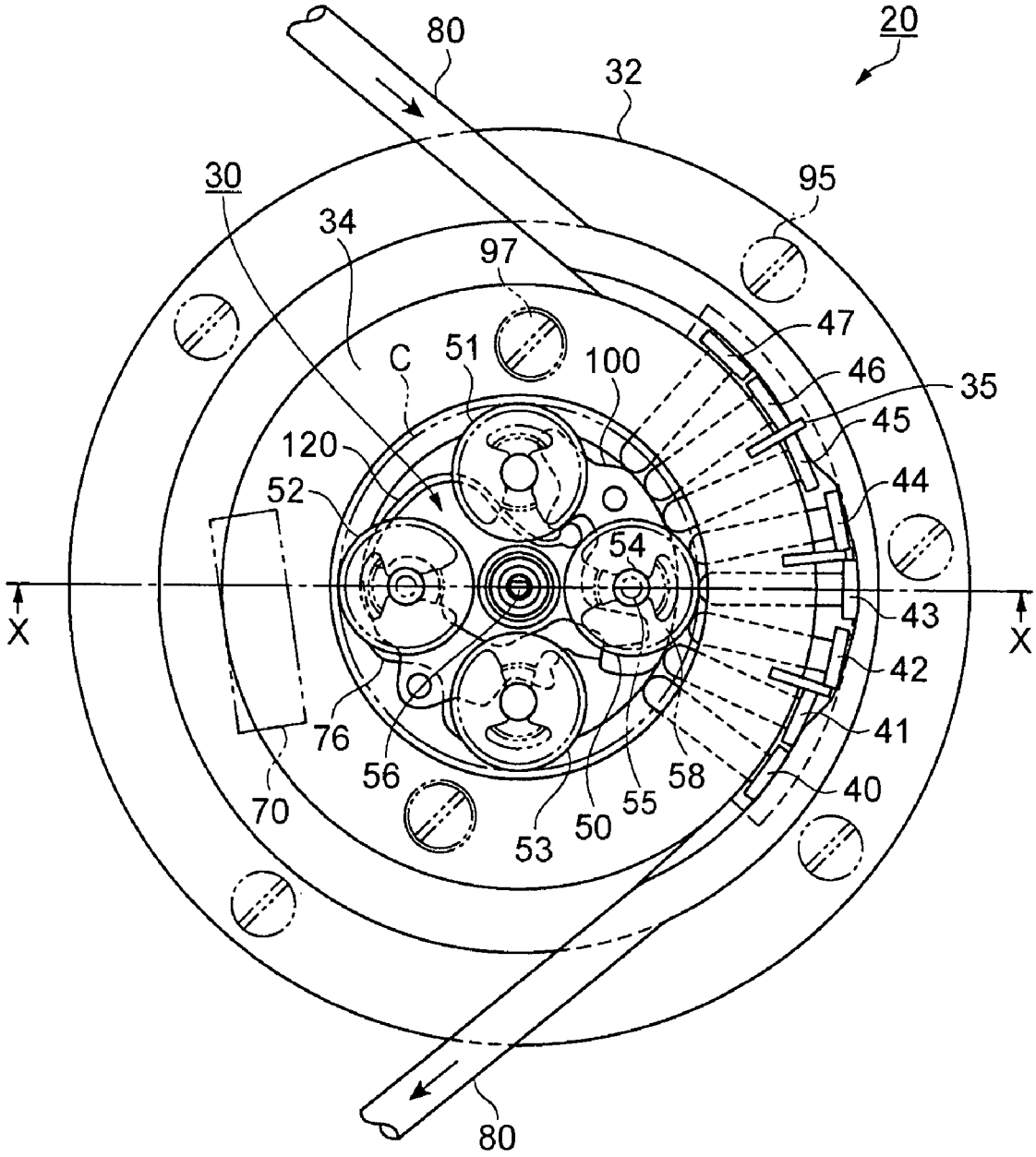
FIG. 2 A top plan view (a tube open state) showing a fluid transporting device according to Mode of Embodiment 1 of the invention.
Figure 3:
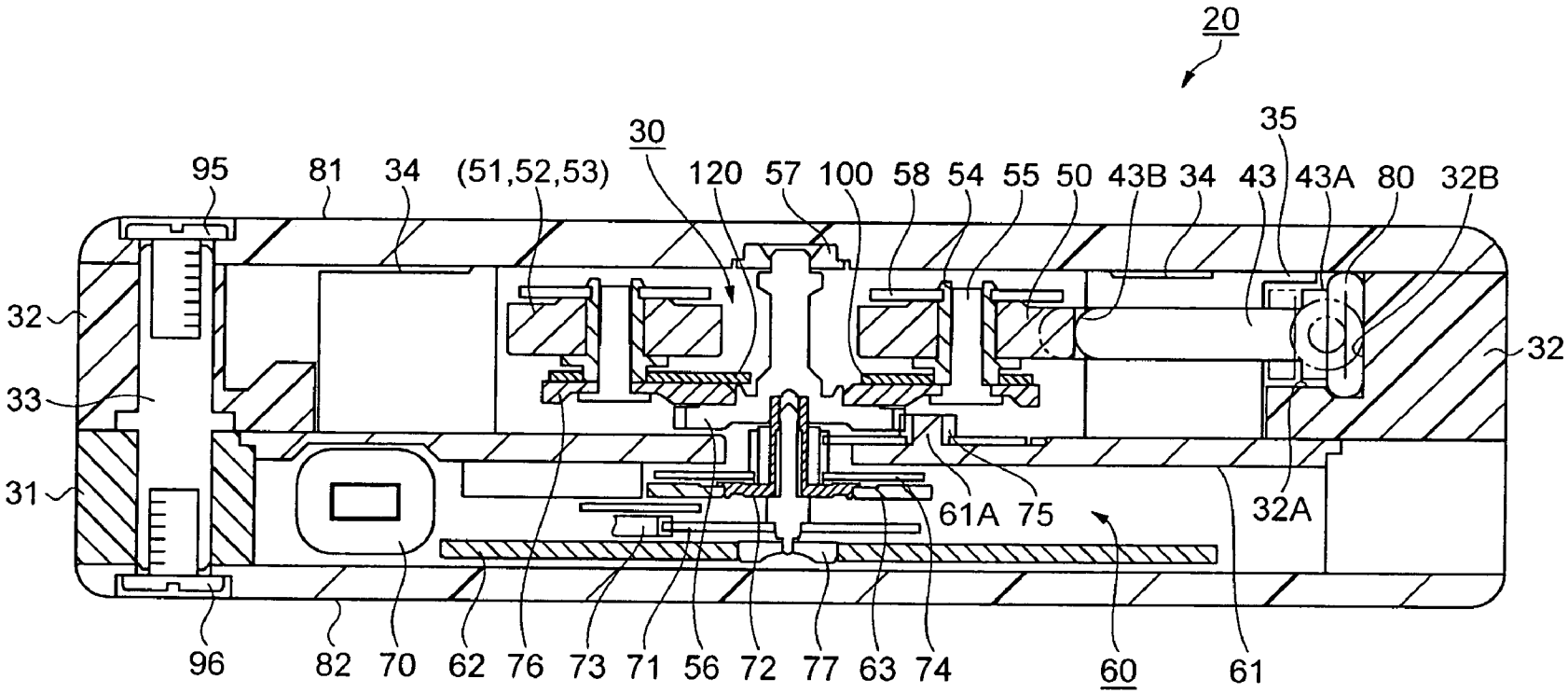
FIG. 3 A sectional view showing an X-X section in FIG. 2 of the fluid transporting device according to Mode of Embodiment 1 of the invention.

FIG. 2 is a top plan view showing a mechanism for transporting the fluid of the fluid transporting device 20 according to this mode of embodiment. FIG. 3 is a sectional view an X-X section of FIG. 2. Here, FIG. 2 shows the state, in which the upper cover 81 is perspectively shown so as to make the description understandable. In FIG. 2 and FIG. 3, the fluid transporting device 20 is basically constituted of a rotary pressure mechanism 30 for pressure the tube 80 by the writhing motions thereby to transport the fluid, and a drive unit 60 for driving the rotary pressure mechanism 30. The rotary pressure mechanism 30 and the drive unit 60 are constituted to lie in the sectional direction (as referred to FIG. 3).

At first, the description is made on the structure and the drive of the drive unit 60. In FIG. 3, the drive unit 60 is provided with a first frame 61 of a plate shape, a second frame 62 and a third frame 63. The spaces between those individual frames are provided with motors and transmission gear trains for applying the drive forces to the rotary pressure mechanism 30, and drive circuits for the drive controls (although both are not shown).

In this mode of embodiment, the motor is exemplified by a step motor adopted in a quartz watch or the like, and a coil block 70 is arranged outside of the rotary pressure mechanism 30, as viewed in the top plan view. The step motor is provided, although not shown, with a stator magnetically coupled to the coil block 70, and a rotor disposed in the stator. The rotor is rotated on the basis of signals coming from the drive circuit (although not shown). This drive circuit is stored in advance with predetermined drive patterns, so that the step motor is drive by the signals based on the drive patterns.

Although not shown, the drive circuit and a battery as a drive source are arranged in the space which is formed by the first frame 61 and the lower cover 82, and the battery is arranged at a position not to intersect with the coil block 70 and the transmission gear train. Moreover, the lower cover 82 is fixed by means of fixing screws 96 so that the battery can be easily replaced by removing the lower cover 82.

The rotations of the rotor are reduced to a predetermined reduction ratio by a plurality of not-shown transmission gears and are transmitted to a first transmission gear 71. The first transmission gear 71 is borne between a bearing 77 disposed in the second frame 62 and a second transmission gear shaft 72 embedded in the third frame 63. The rotations of the first transmission gear 71 are transmitted through a third transmission gear 73, a fourth transmission gear 74 and a fifth transmission gear 75 to a center gear 56 positioned at the center of the rotary pressure mechanism 30.

The fourth transmission gear 74 is loosely fitted on the center stem of the second transmission gear shaft 72, and the fifth transmission gear 75 is loosely fitted on a support pin 61A disposed in the first frame 61.

In the drive unit 60, the first frame 61 is fixed in the ring-shaped drive unit frame 31 by the not-shown fixing screws. The second frame 62 and the third frame 63 are fixed at a predetermined spacing by the not-shown fixing screws on the first frame 61. Thus, the drive unit 60 is united but for the fifth transmission gear 75. The rotary pressure mechanism 30 is mounted over the drive unit 60.

Next, the description is made on the structure of the rotary pressure mechanism 30. As shown in FIG. 2, and FIG. 3, the rotary pressure mechanism 30 is basically constituted of: the center gear 56 to be rotated by the rotating force transmitted from the drive unit 60; a roller bed 76 to be rotated integrally with the center gear 56; and four rollers 50 to 53 disposed on the upper face of the peripheral edge portion of the roller bed 76. Outside of the rotary pressure mechanism 30, a slide frame 34 is provided with eight push pins 40 to 47 which are so inserted as to move radially from the rotation center of the roller bed 76, and the tube 80 for the fluid to flow therein.

The roller bed 76 is made of a disc-shaped plate member, which bears the center gear 56 at its central portion. The rotating force is transmitted to the center gear 56 from the fifth transmission gear 75, so that the roller bed 76 rotates on the second transmission gear shaft 72. Into the center hole of the roller bed 76, there is inserted the second transmission gear shaft 72, which bears the center wheel 56 together with a bearing 57 disposed in the upper cover 81.

The roller bed 76 is provided with the rollers 50 to 53 acting as four push members. The roller 50 is rotatably borne on a roller shaft 54 disposed in a roller lever 100 mounted on the upper face of the roller bed 76 and acting as the rocking lever, so that the roller 50 can move in the direction of a straight line X-X in FIG. 2 by rocking the roller lever 100. The roller lever 100 is regulated in position by a roller lever spring 120 as a regulating lever. These roller lever 100 and the roller lever spring 120 constitute a switching mechanism.

In FIGS. 2 and 3, the roller 50 is regulated at the same position as that of the remaining rollers 51 to 53 at a distance from the rotation center of the roller bed. As the roller lever 100 rotates clockwise in association with the rotating motions of the rotary pressure mechanism 30, the rollers 50 to 53 push the push pins sequentially from the push pin 47 to the push pin 40 to the outside. In accordance with this, the push pins 47 to 40 perform the writhing motions to press the tube 80 sequentially thereby to transport the fluid (in the direction of arrow, as shown). FIG. 3 shows the state, in which the roller 50 is pushing the push pin 43.

Around the outer circumference of the roller bed 76 having those rollers 50 to 53, there is disposed the ring-shaped slide frame 34.

This slide frame 34 also has its center aligned with the center of rotation of the roller bed 76, and is precisely positioned by the not-shown positioning member and fixed on the first frame 61 by means of fixing screws 97 (as referred to FIG. 2). In the slide frame 34, there are formed eight holes, which extend therethrough radially of the center from the inner side to the outer side. The push pins 40 to 47 are individually inserted into those holes. The push pins 40 to 47 have sizes set to move in the axial direction.

The push pin 43 is representatively described by way of example, because the push pins 40 to 47 have the identical shapes (as referred to FIG. 3). The push pin 43 has its one end portion formed into a flange-shaped push portion 43A and its other end portion rounded into a semispherical push portion 43B. In this structure, the push portion 43B is pushed by the roller 50 so that the push portion 43A presses the tube 80 onto a tube guide wall 32B thereby to squeeze and feed the fluid. The push pin 43 does not press the tube 80 (as indicated by double-dotted lines in FIG. 3) when it does not contact with the rollers 50 to 53.

Around the outer circumference of the slide frame 34, there is further disposed the ring-shaped tube frame 32. This tube frame 32 has its center aligned like the slide frame 34 with the center of rotation of the roller bed 76. In the inner circumference portion of the tube frame 32, there is formed a step-shaped tube mounting portion 32A for mounting the tube 80. This tube 80 has its planar position regulated between that tube mounting portion 32A and the push portion 43A of the push pin 43. Within the range where the push pins 40 to 47 are absent, the tube 80 is curved and mounted in the shape shown in FIG. 2 by the (not-shown) tube guide grooves formed in the slide frame 34 and the tube frame 32.

The push pins 40 to 47 are radially extended from the center of rotations of the roller bed 76, and the tube guide wall 32B for pressing the tube 80 is also formed in a circle concentric to the center of rotations of the roller bed 76. As a result, the tube 80 is pressed substantially at a right angle by the push pins 40 to 47.

The slide frame 34 is provided with a tube holder 35 partially protruding toward the upper face of the tube 80 so that the tube 80 may not float. This tube holder 35 is arranged in plurality (e.g., three in FIG. 2) between the push pins 40 to 47 for pressing the tube 80.

In the fluid transporting device 20 of this embodiment, the aforementioned drive unit 60 and the rotary pressure mechanism 30 are overlaid, and a fixing pin 33 borne in the drive unit frame is inserted into the tube frame 32 and the upper cover 81. The drive unit 60 and the rotary pressure mechanism 30 are fixed by the fixing screws 95. Moreover, the lower cover 82 is also integrally constituted by fixing it by the fixing screws 96.

Subsequently, the feeding actions of the fluid in this mode of embodiment are described with reference to FIG. 2. The roller bed 76 is rotated by the drive unit 60 in the fluid feeding direction (as indicated by the arrow in the drawing), that is, clockwise in this mode of embodiment. The description is made by way of the roller 50. Before the outermost circumference portion of the roller 50 intersects the push pin 47, the push pins 47 to 40 are in the open states. As the roller bed 76 rotates, the push pin 47 moves toward the tube 80 from the position, at which the outermost circumference (as indicated by a locus C in the drawing) of the roller 50 contacts with the end portion of the push pin 47, thereby to start the push of the tube 80.

As the roller bed 76 rotates, moreover, the roller 50 pushes the push pins sequentially in the order of the push pins 46, 45 and 44. At this time, the pushing stroke becomes the maximum when the center of rotation of the roller bed 76, the center of rotation of the roller and the center line of the push pin make a straight line. After this, the roller gradually leaves the push pin so that the tube 80 is released from the push of the push pins. The motions thus pressing the tube 80 sequentially are called the writhing motions, by which the tube 80 is squeezed to transport the fluid. The device for transporting the fluid by making use of such writhing motions is called the writhing type fluid transporting device.

The structure and actions of the rotary pressure mechanism 30 are described in detail with reference to FIG. 4 to FIG. 8.

Figure 4:
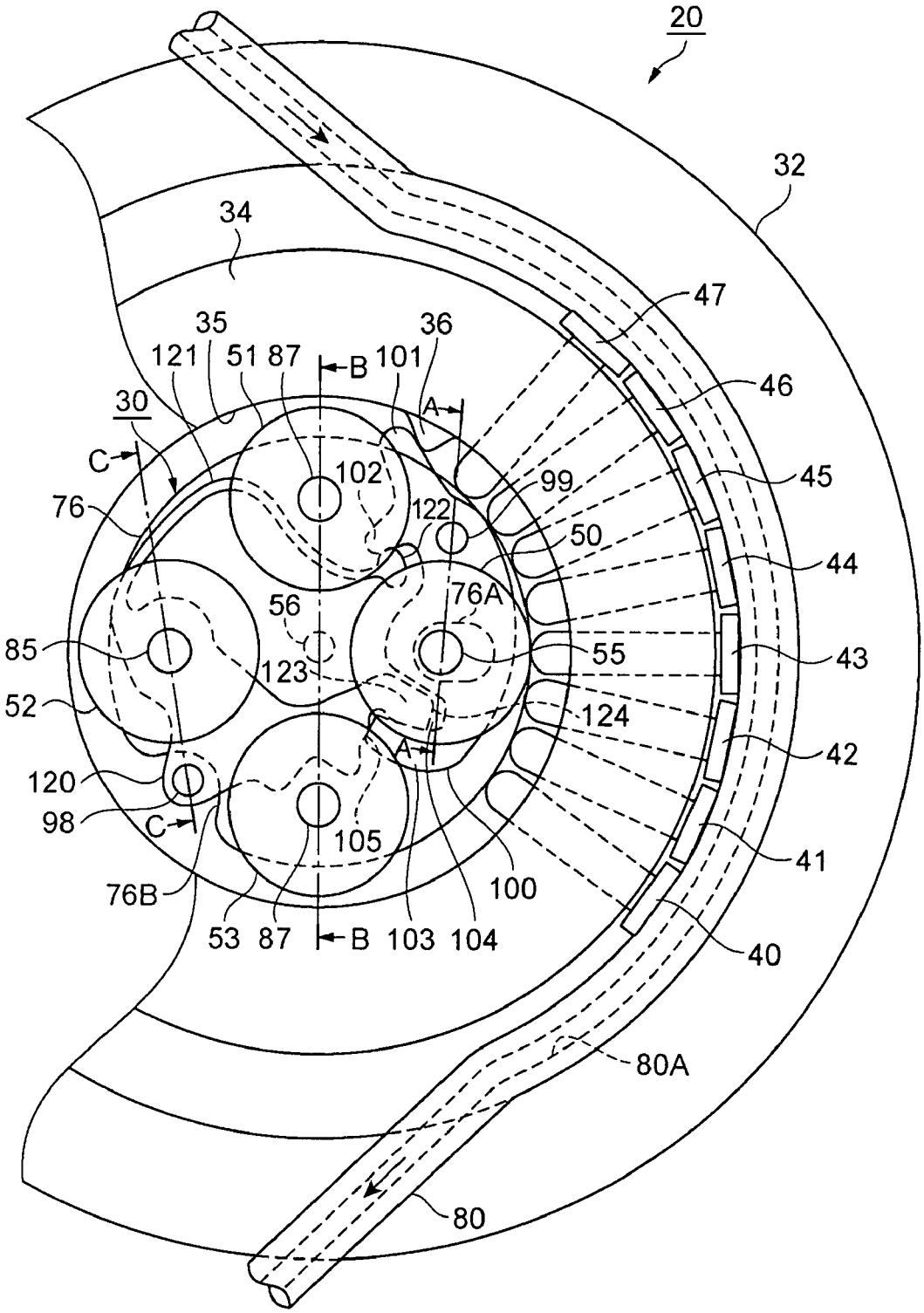
FIG. 4 A top plan view showing a structure of a rotary pressure mechanism according to Mode of Embodiment 1 of the invention.
Figure 5:
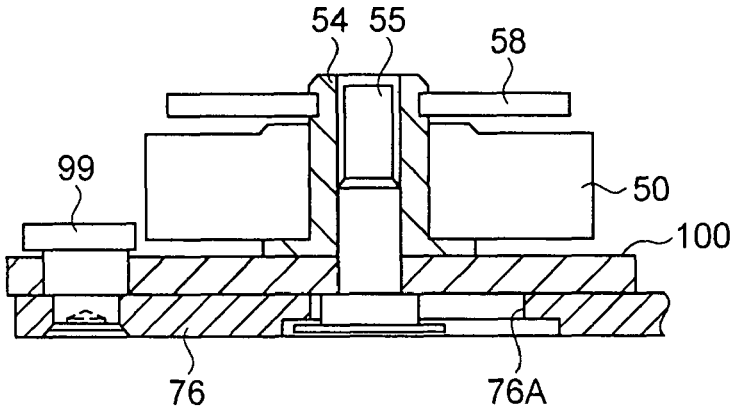
FIG. 5 A sectional view showing an A-A section in FIG. 4 of the rotary pressure mechanism according to Mode of Embodiment 1 of the invention.
Figure 6:
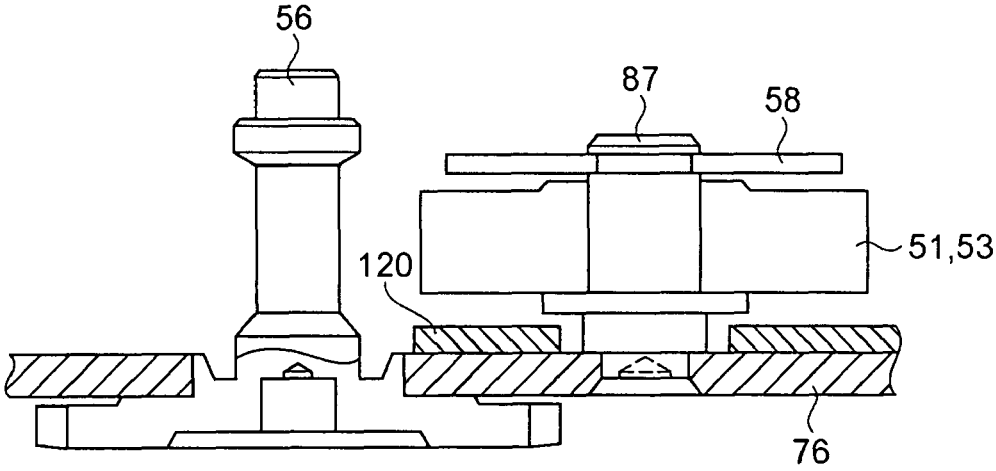
FIG. 6 A sectional view showing a B-B section in FIG. 4 of the rotary pressure mechanism according to Mode of Embodiment 1 of the invention.
Figure 7:
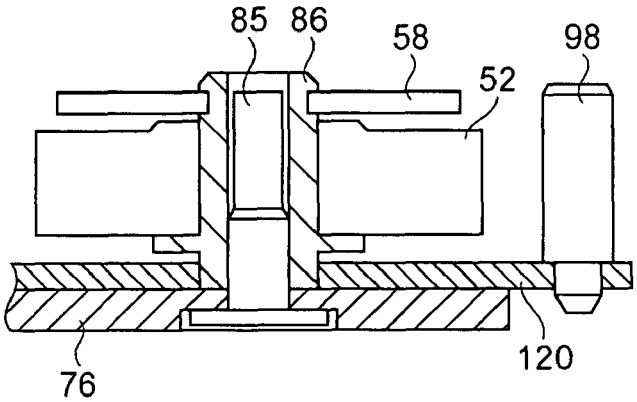
FIG. 7 A sectional view showing a C-C section in FIG. 4 of the rotary pressure mechanism according to Mode of Embodiment 1 of the invention.

FIG. 4 is a top plan view showing the rotary pressure mechanism 30 according to this mode of embodiment; FIG. 5 a sectional view A-A in FIG. 4; FIG. 6 is a sectional view B-B; and FIG. 7 is a sectional view C-C. Here, FIG. 4 shows the state, in which the roller 50 releases the tube 80.

At first, the description is made on the roller lever 100 and the roller 50. In FIGS. 4 and 5, the roller lever 100 is borne in a rocking manner in the roller bed 76 by a roller lever pin 99.

The roller lever 100 is provided, at its one end portion, with an island-shaped push portion 101 and a spring engaging portion 102 engaging with a leading end portion 122 of the roller lever spring 120 protruding substantially at a right angle from midway of the push portion 101, and, at its other end portion, with a bill-shaped roller lever spring engaging portion 103.

Substantially at the central portion of the roller lever 100, there is borne a roller support pin 55, which has a flange portion from the lower face of the roller lever 100. From the upper face, the cylindrical roller shaft 54 having a flange portion is press-fitted on the roller support pin 55. The roller 50 is rotatably mounted on the roller shaft 54 and retained by a C-ring 58. Thus, the roller bed 76, the roller lever 100 and the roller 50 are integrated.

In the roller bed 76, there is formed an elliptical hole 76A, which is sized within such a range that the flange portion of the roller shaft 54 does not contact when the roller lever 100 rocks.

Subsequently, the description is made on the roller lever spring 120 and the roller 52. In FIG. 4 and FIG. 7, the roller lever spring 120 is borne in a rocking manner in the roller bed 76 by a roller shaft 86. Specifically, a roller support pin 85 having a flange portion is borne in the direction from the lower face of the roller bed 76, and the roller shaft 86 is press-fitted on the roller support pin 85 in the direction from the upper face. The roller 52 is rotatably fitted on that roller support pin 85 and retained by the C-ring 58. The roller 52 is arranged at a position of 180 degrees of the rotation center of the roller bed 76 with respect to the roller 50.

The roller lever spring 120 is provided, at its leading end portion, with an island-shaped roller lever engaging portion 123 and, at its other tail portion, with a spring portion 121. An operation pin 98 is embedded as an operation member at an intermediate position between the roller spring engagement portion 123 and the root portion of the spring portion 121 and in the vicinity of the outer circumference portion of the roller bed 76. The operation pin 98 has substantially the same height as the upper face of the rollers 50 to 53, and is provided to release the engagement between the later-described roller lever 100 and the roller lever spring 120 forcibly.

Here, the roller bed 76 is provided with an operation pin relief portion 76B of a range, within which the operation pin 98 can move.

The roller lever 100 is so biased at the spring engaging portion 102 by the leading end portion 122 of the roller lever spring 120 as is given a clockwise turning force on the roller lever pin 99. On the other hand, the leading end portion 105 of the roller level spring engaging portion 103 abuts against the roller lever engaging portion 123 of the roller lever spring 120. As a result, the roller 50 is located at the longest position from the tube 80.

The roller 50 is regulated to the position, at which the push pins 40 to 47 open the tube 80. Here, the roller lever 100 and the roller lever spring 120 are designed into such shapes that they may not interfere with the rollers 51 and 53 and a protruding portion 36 as the roller lever pushing portion formed on the inner circumference of the slide frame 34.

The structures of the rollers 51 and 53 are described in the following. In FIG. 4 and FIG. 6, the center gear 56 is borne at the center of rotation of the roller bed 76. Moreover, the rollers 51 and 53 are arranged at an angle of 90 degrees of the rotation center of the roller bed 76 with respect to the rollers 50 and 52, respectively. The roller 53 is described by way of example, because the rollers 51 and 53 have the common structure. The roller 53 is rotatably fitted on a roller shaft 87 having a flanged portion and embedded toward the upper face of the roller bed 76, and is retained by the C-ring 58.

The aforementioned rollers 50 to 53 have the identical shapes and are mounted at the common height on the upper face of the roller bed 76.

Next, the state, in which the roller bed 76 is rotated so that the push pins 40 to 47 are pushed by the rollers 50 to 53, is described with reference to the drawings. Here, the sectional relations are omitted on their description, because they are identical to those of the structure shown in FIG. 5 to FIG. 7.

Figure 8:
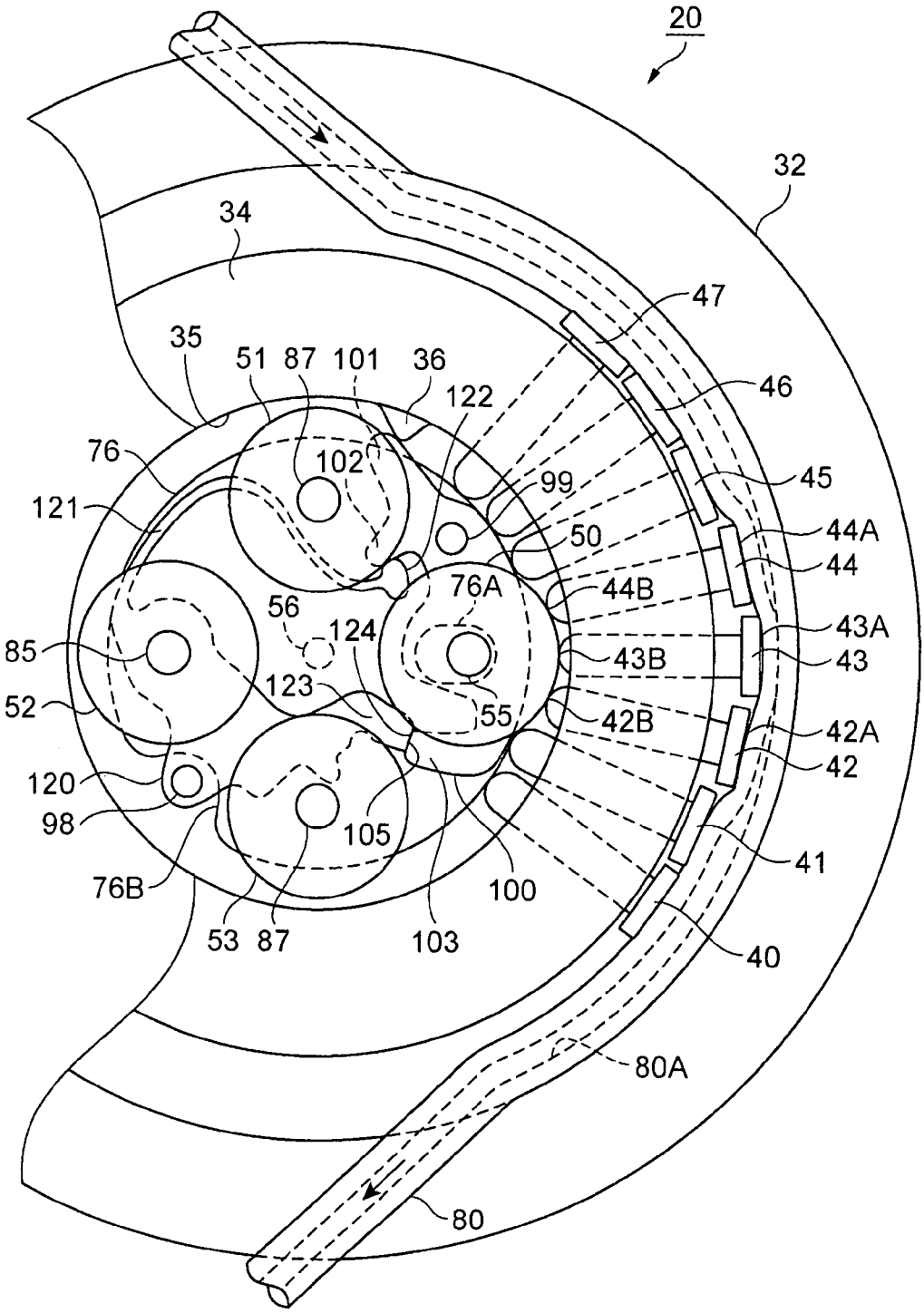
FIG. 8 A top plan view (a tube closed state) showing the fluid transporting device according to Mode of Embodiment 1 of the invention.

FIG. 8 is a top plan view showing the state, in which the roller bed 76 is rotated so that the roller 50 moves from the state shown in FIG. 4 to the position where it can press the tube 80. When the roller bed 76 is clockwise rotated by the drive unit 60, as shown in FIG. 8, the push portion 101 of the roller lever 100 abuts against the protruding portion 36 protruding from the inner circumference of the slide frame 34.

The roller lever 100 is rocked counter-clockwise on the roller lever pin 99. Then, the spring portion is pushed by the spring engaging portion 102 of the roller lever 100 so that the roller lever engaging portion 123 of the roller lever spring 120 turns clockwise. Thus, the roller lever spring engaging portion 103 of the roller lever 100 and the roller lever engaging portion 123 of the roller lever spring 120 are disengaged to bring the leading end portion 105 of the roller lever 100 and a roller lever pushing portion 124 of the roller lever spring 120 into abutment against each other.

The roller lever 100 and the roller lever spring 120 are biased clockwise and counter-clockwise, respectively, by the elastic force of the spring portion 121 so that their individual positions are regulated in the shown states. When the roller bed 76 is rotated clockwise in this state, the roller 50 pushes the push pins sequentially in the order of push pins 44, 43, 42, 41 and 40. The maximum locus of rotation of the roller 50 is designed to the size to close a fluid flowing portion 80A of the tube 80.

As the roller bed 76 is thus rotated, the individual rollers push the push pins 47 to 40 consecutively. By the writhing motions of those push pins, the tube 80 is squeezed to transport the fluid in the arrow direction, as shown. The roller lever 100 and the roller lever spring 120 are rotated while being held in the state shown in FIG. 8, so that the transportation of the fluid can be continued.

Here, the rollers 50 to 53 are rotated, when they push the push pins 40 to 47, in the direction backward of the rotating direction of the roller bed 76, that is, counter-clockwise by the frictional force, so that the frictional forces with the push pins 40 to 47 are reduced.

Here in this state, the roller bed 76 can also be rotated backward (or counter-clockwise) thereby to transport the fluid backward. In this case, the fluid storing container 90 (as referred to FIG. 1) is mounted on the opposite-side leading end of the tube 80.

Here is described the operations of the case, in which the roller position is changed from the state (or the fluid transporting state), as shown in FIG. 8, to the state (in which the tube 80 is not pressed), as shown in FIG. 4. In FIG. 8, the operation pin 98 embedded in the roller lever spring 120 is operated and turned counter-clockwise on the roller support pin 85, the disengagement occurs between the roller lever pushing portion 124 of the roller lever spring 120 and the leading end portion 105 of the roller lever 100.

The roller lever 100 is pushed clockwise by the spring portion 121. Simultaneously with that disengagement, therefore, the roller lever pushing portion 124 enters a space 104 in the root of the roller lever spring engaging portion 103 of the roller lever 100, thereby to establish the state shown in FIG. 4, so that the tube 80 is released.

Either at the time of interrupting the drive of the fluid transporting device 20 or before the start of the drive (both in the state shown in FIG. 4), it is preferred to provide the fluid outlet side of the tube 80 with a plug member for preventing the natural flow of the fluid.

Here, Mode of Embodiment 1 thus far described exemplifies the structure, which is provided with the four rollers and the eight push pins. Despite of this description, however, the embodiment can select the numbers of rollers and push pins arbitrarily.

Moreover, Mode of Embodiment 1 thus far described exemplifies the structure, in which the spring portion 121 is integrally formed in the roller lever spring 120. However, it is also possible to provide the spring portion by itself.

According to Mode of Embodiment 1 thus far described, therefore, the roller lever 100 and the roller lever spring 120 can hold the push pins 40 to 47 at the positions to open and close the tube 80. As a result, it is possible to hold the two positions reliably. Moreover, the closed state of the tube 80 is held so that the roller bed 76 can be rotated back and forth to select the transporting direction of the fluid arbitrarily.

Moreover, the positions for the roller lever 100 having the roller 50 to open or close the tube 80 are regulated and held by the roller lever spring 120. It is, therefore, possible to keep the open and closed states of the tube 80 reliably.

Moreover, the roller lever spring 120 is provided with the spring portion 121 for biasing the roller lever 100 and the roller lever spring 120 to rotate individually in the same direction, so that the engagement and disengagement of the roller lever 100 and the roller lever spring 120 can be realized by the simple structure.

In accordance with the rotations of the roller bed 76, moreover, the push pins 40 to 47 are moved from the position, at which the tube 80 is released, to the position, at which the same can be pressed, so that the fluid transportation can be started without any manual operation. Moreover, this state is held by the roller lever 100 and the roller lever spring 120. As a result, it is possible to perform the stable fluid transportation and to rotate the roller bed 76 backward to set the flow direction of the fluid arbitrarily.

By operating the operation pin 98, moreover, the tube 80 can be brought into the released state. When the drive of the fluid transporting device 20 is interrupted for a long time, for example, the tube 80 can be prevented from being elastically deformed, if might otherwise be pressed for a long time. Moreover, this state can be manually established to improve the disassembling and assembling properties thereby to facilitate the maintenance.

Moreover, the push pins 40 to 47 are pushed by the rollers 50 to 53, so that the rollers 50 to 53 can be rotated backward of the rotating direction of the roller bed 76 by the frictional forces between the rollers 50 to 53 and the push pins 40 to 47. As a result, the frictional resistance can be reduced to reduce the driving force of the roller bed 76, so that the output torque of the motor acting as the drive source can be lowered to reduce the size. Thus, it is possible to reduce the size of the fluid transporting device 20.

Moreover, the fluid transporting device 20 and the fluid storing container 90 are enabled to communicate by the tube 80, so that the fluid storing container 90 can be easily replaced and handled. Moreover, the fluid transporting device 20 can be repeatedly used to raise the economical advantage.

Next, a fluid transporter according to Mode of Embodiment 2 of the invention is described with reference to the accompanying drawing. Mode of Embodiment 1 thus far described has the structure, in which the fluid transporter 10 comprises the fluid transporting device 20 and the fluid storing container 90 made separate from each other and made to communicate via the tube 80. On the contrary, Mode of Embodiment 2 is characterized in that the fluid transporting device and the fluid storing container are integrated in a casing.

Figure 9:
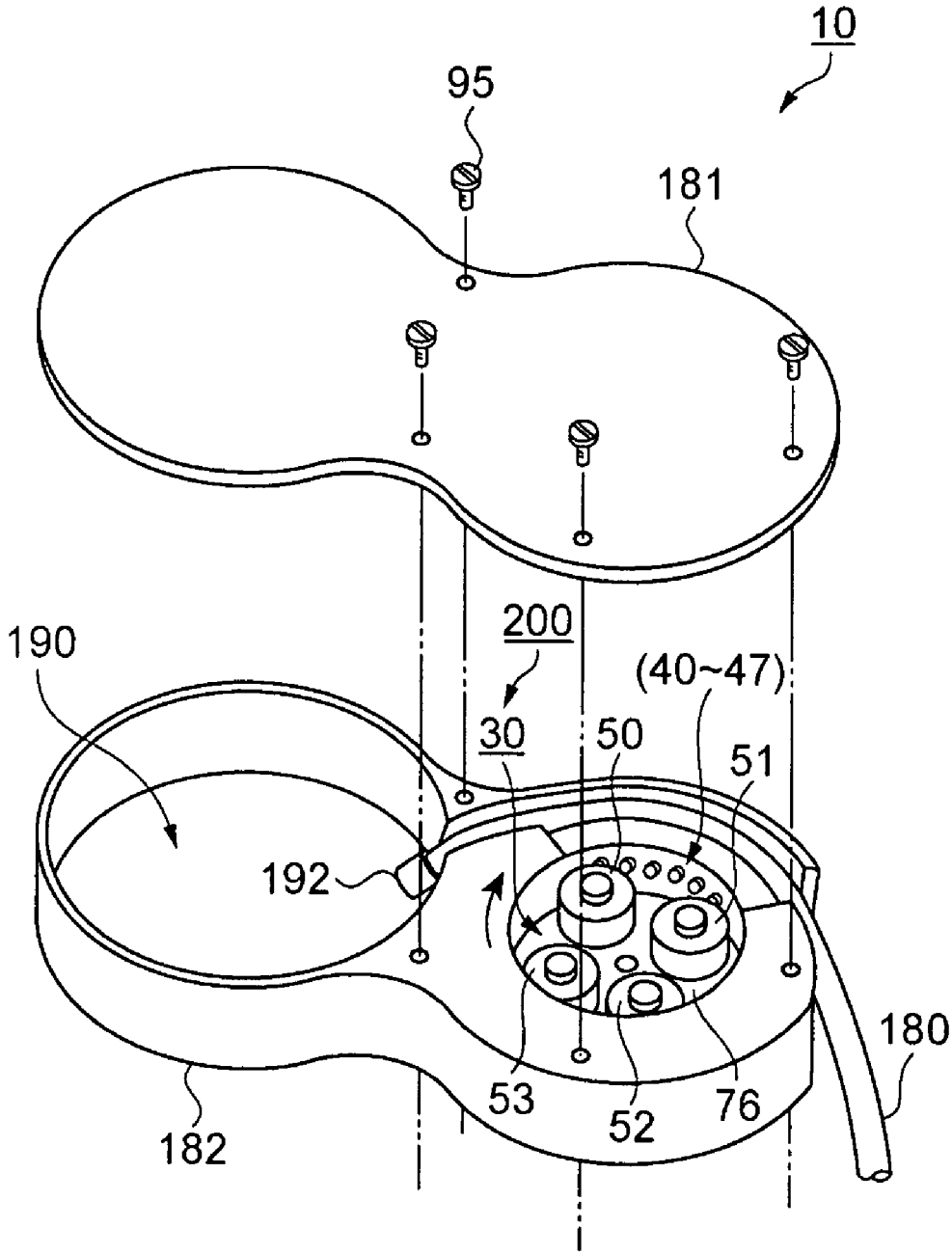
FIG. 9 An exploded perspective view showing a constitution of a fluid transporter according to Mode of Embodiment 2 of the invention.

FIG. 9 is an exploded perspective view showing the fluid transporter according to Mode of Embodiment 2. The description is made by designating the portions common to Modes of Embodiment 1 and 2 by the common reference numerals. As shown in FIG. 9, the fluid transporter 10 is provided with a fluid transporting device portion 200 corresponding to the fluid transporting device in the casing of a gourd shape in a top plan view, and a fluid storing portion 190 corresponding to the fluid storing container. The casing is constituted of a case 182 corresponding to the lower cover of Mode of Embodiment 1, and an upper cover 181, which are fastened and fixed by the fixing screws 95 (four in FIG. 9).

In the case 182, there are formed two parallel recesses, one of which is provided with the rotary pressure mechanism 30 and the (not-shown) drive unit, and the other of which is provided with a container-shaped fluid storing portion 190. The fluid storing portion 190 and the rotary pressure mechanism 30 are made to communicate with each other by a tube 180. The tube 180 is extended at its one end portion 192 to the fluid storing portion 190, at its midway through the outer circumference portion of the rotary pressure mechanism 30, and at its other end portion to the outside of the fluid transporter 10.

The rotary pressure mechanism 30 adopts the same structure as that of the aforementioned Mode of Embodiment 1, in which the fluid is transported by the writhing motions of the push pins 40 to 47 (as referred to FIGS. 2 and 3).

The communication among one end portion 192 of the tube 180, the case 182 and the upper cover 181 is provided with the not-shown packing thereby to prevent the fluid from leaking from the fluid storing portion 190 to the inside of the rotary pressure mechanism 30. The fluid storing portion 190 is desirably provided with an opening to be closed with an air-permeable film or the like so that it establishes a pressure substantially equal to that of the ambient pressure when the upper cover 181 is mounted.

Alternatively, an elastic thin film for reducing the volume as the fluid flows can also be formed at positions corresponding to the upper and lower faces of the fluid storing portion 190 of the upper cover 181 and the case 182.

Here, the upper cover 181 and the case 182 may be fixed not only by means of the screws but also by adhering means such as solvent weld or adhesion. In case the fluid transporter 10 of the invention is mounted-inside or outside a living body, a material excellent in an organic matching property, such as polysulfone or a resin of a silicone group is desirably adopted for the material for the case or the upper cover 181.

According to Mode of Embodiment 2 thus far described, therefore, the rotary pressure mechanism 30 and the fluid storing portion 190 are arranged to have no overlap, so that the size can be reduced without increasing the thickness. Moreover, the casings for the rotary pressure mechanism 30 and the fluid storing portion 190 are formed into one, so that the cost can be reduced.

Moreover, the roller bed 76 can be rotated backward, as has been described in Mode of Embodiment 1, the fluid can be transported to the fluid storing portion 190 from the tank which is disposed outside of the fluid transporter 10. At this time, it is preferred that the fluid storing portion 190 is provided with an air communication hole.

Here, the invention should not be limited to the foregoing mode of embodiments, but could contain modifications and improvements within the scope to achieve the object of the invention.

In the aforementioned Mode of Embodiment 1, for example, the fluid flow rate (or the transportation rate) can be set by setting the number of rollers, the number of push pins and so on arbitrarily. However, the rotating speed of the roller bed 76 can also be selected by storing the not-shown drive control circuit with a plurality of pieces of information capable of selecting the rotating speed arbitrarily. Moreover, the fluid can also be intermittently fed by storing the roller bed 76 with the information for the intermittent drive.

Moreover, the aforementioned Mode of Embodiment 1 exemplifies the structure having one movable roller, but the structure can also move a plurality of rollers.

Thus, the tube 80 can be brought into the open state at an arbitrary position without being limited by the rotational position of the roller bed 76.

In the aforementioned Mode of Embodiment 1, moreover, there is disclosed the structure, in which the push pins 40 to 47 are driven by the rollers 50 to 53 thereby to press the tube 80. It is, however, possible to adopt the structure, in which the tube is directly pressed by the rollers 50 to 53.

Thus, the slide frame 34 and the push pins 40 to 47 can be eliminated to make the planar size smaller.

According to the aforementioned Mode of Embodiment 1 and Mode of Embodiment 2, therefore, it is possible to provide both a small fluid transporting device, which can rotate the rotary pressure mechanism forward and backward, which allows no leakage of the fluid even in the drive intermitting state and which can retain a stable fluid feeding rate, and a fluid transporter which is provided with that fluid transporting device.

The fluid transporting device and the fluid transporter of the invention thus far described can be mounted inside or outside of a variety of machine apparatus so as to transport a fluid such as water, brine, chemicals, oils, aromatic liquids, ink or gases. Moreover, the fluid transporter can be utilized by itself for feeding and supplying the aforementioned fluid, but should not be limited thereto.

Here, the fluid transporter according to this invention has its outer casing made of the material excellent in the organic matching property and is small so that it can suit a medical device to be mounted in a living body.

The invention claimed is:

1. A fluid transporting device comprising:

a tube frame having a tube guide wall for arranging a tube having an elasticity in an arcuate shape;

a rotary pressure mechanism arranged, when the tube is arranged in the tube frame, on the side opposite to the guide wall side of the tube, such that its center of rotation is aligned with the center of the arc of the tube guide wall, and having a plurality of rollers;

a plurality of push pins interposed between the tube and the rotary pressure mechanism and arranged radially of the center of rotation of the rotary pressure mechanism;

a switching mechanism disposed in the rotary pressure mechanism for allowing at least one of the rollers to move, in association with the rotating motions of the rotary pressure mechanism, to a position where the push pins release the tube and a position where the push pins are capable of pressing the tube, the switching mechanism including a rocking lever for moving at least one of the rollers to the position where the push pins release the tube and the position where the push pins are capable of pressing the tube, and a regulating lever for engaging with the rocking lever to regulate the position of the rocking lever and to hold the same position; and a slide frame that supports the plurality of push pins, the slide frame including a protruding portion fixedly protruding toward the rotary pressure mechanism such that an end portion of the rocking lever abuts, as the rotary pressure mechanism rotates, against the protruding portion so that the rocking lever is rocked to move at least one of the rollers from the position for the push pins to release the tube to the position for the push pins to press the tube.

2. The fluid transporting device as set forth in claim 1, wherein the protruding portion is disposed apart from and near the outer circumference of the rotary pressure mechanism.

3. The fluid transporting device as set forth in claim 1, wherein the regulating lever is provided at its tail portion with a spring portion for applying a biasing force to rock the regulating lever in one direction; and in that the spring portion biases the rocking lever in a direction to engage with the regulating lever.

4. The fluid transporting device as set forth in claim 1, wherein the regulating lever includes an operation member for releasing the engagement with the rocking lever and for moving at least one of the rollers from the position for the push pins to press the tube to the position for the push pins to release the tube.

5. A fluid transporter comprising:

the fluid transporting device as set forth in claim 1, and a fluid storing container for storing a fluid, wherein the fluid transporting device and the fluid storing container communicate with each other by the tube having elasticity so that the fluid in the fluid storing container is transported by the fluid transporting device.

6. The fluid transporter as set forth in claim 5, wherein the fluid transporting device and the fluid storing container are formed in parallel in the planar direction in a casing.

7. The fluid transporting device as set forth in claim 3, wherein the regulating lever includes an operation member for releasing the engagement with the rocking lever and for moving at least one of the rollers from the position for the push pins to press the tube to the position for the push pins to release the tube.

8. A fluid transporter comprising:

the fluid transporting device as set forth in claim 2; and a fluid storing container for storing a fluid, wherein the fluid transporting device and the fluid storing container communicate with each other by the tube having elasticity so that the fluid in the fluid storing container is transported by the fluid transporting device.

9. A fluid transporter comprising:

the fluid transporting device as set forth in claim 3; and a fluid storing container for storing a fluid, wherein the fluid transporting device and the fluid storing container communicate with each other by the tube having elasticity so that the fluid in the fluid storing container is transported by the fluid transporting device.

10. A fluid transporter comprising:

the fluid transporting device as set forth in claim 4; and a fluid storing container for storing a fluid, wherein the fluid transporting device and the fluid storing container communicate with each other by the tube having elasticity so that the fluid in the fluid storing container is transported by the fluid transporting device.

* * * * *